United States Patent [19]

Katayama et al.

[11] Patent Number: 4,494,518

[45] Date of Patent: Jan. 22, 1985

[54] ENGINE IGNITION INTERPOLATION APPARATUS

[75] Inventors: Hiroomi Katayama, Machida; Yoshiaki Hirosawa, Shiki, both of Japan

[73] Assignees: New Nippon Electric Co., Ltd., Osaka; Honda Giken Kogyo Kabushiki Kaisha, Tokyo, both of Japan

[21] Appl. No.: 433,913

[22] Filed: Oct. 12, 1982

[30] Foreign Application Priority Data

Oct. 12, 1981 [JP] Japan ..... 56-160912

[51] Int. Cl.[3] ..... F02P 9/00

[52] U.S. Cl. ..... 123/612; 123/617; 123/414; 123/643

[58] Field of Search ..... 123/414, 612, 613, 617, 123/643, 146.5 A, 476, 477, 490

[56] References Cited

U.S. PATENT DOCUMENTS 4,265,211 5/1981 Meloeny ..... 123/643

4,317,437 3/1982 Lindgren ..... 123/414

*Primary Examiner*—Andrew M. Dolinar

*Attorney, Agent, or Firm*—Staas & Halsey

[57] ABSTRACT

An engine ignition interpolation apparatus including three reference position sensors, a single crank angle sensor and a counter resettable by outputs from the reference position sensors and used for counting output pulses from said crank angle sensor. Also included are a decoder for generating an output when the counter produces a count output which exceeds a preset value, flip-flops connected respectively to the reference position sensors in a ring arrangement and triggerable by the outputs from the reference position sensors for synchronous operation therewith, and a logic circuit for seeking conformity between the output from the decoder and set outputs from the flip-flops to produce a quasi or replacement pulse for one of the reference position sensors which fails to produce an output, thereby interpolating a reference position pulse.

12 Claims, 18 Drawing Figures

ENGINE IGNITION INTERPOLATION APPARATUS

CROSS REFERENCES TO RELATED APPLICATIONS

This application is related to two U.S. patent applications concurrently filed herewith, having U.S. application Ser. No. 433,911 and entitled "Control Unit Modifiable Engine Ignition Control Apparatus" and having U.S. application Ser. No. 433,912 and entitled "Input-/Output Unit Modifiable Engine Ignition Control Apparatus" and based on Japanese patent application Nos. 160914/81 and 160913/81, respectively.

BACKGROUND OF THE INVENTION

The present invention relates to an engine ignition interpolation apparatus for interpolating reference position signals when no outputs are issued from engine reference position sensors used in engine ignition control.

Recent rapid developments in electronics technology have resulted in an increased tendency for engine ignition timing to be controlled by a digital system. For example, an electronic engine ignition control circuit for two-wheeled motorcycles is supplied with crank angle pulses generated each time a crank shaft rotates through a unit angle and reference positions pulses representing positions of pistons in respective cylinders. The control circuit counts and processes the crank angle pulses with the reference position pulses being used as references for determining a dwell angle and for controlling ignition timing.

The crank angle pulses are produced by a crank angle sensor which detects teeth cut at a pitch of two degrees around the outer periphery of a crank angle rotor mounted on the crank shaft. The reference position pulses are generated by reference position sensors which correspond respectively to the cylinder pistons and are disposed around the periphery of a reference position rotor mounted on the crank shaft.

A problem with prior engine ignition control systems is that when the reference position sensors or a system for transmitting outputs therefrom fails, normal sensor outputs are not delivered and those cylinders which correspond to the faulty reference position sensors cannot have their ignition timing properly controlled.

SUMMARY OF THE INVENTION

It is an object of the present invention to provide an engine ignition interpolation apparatus capable of generating reference position pulses even when no outputs are issued from reference position sensors.

According to the present invention, the above object can be achieved by utilizing reference position pulses generated by other working reference position sensors and crank angle pulses generated by a crank angle sensor to interpolate reference position pulses that should have been produced from those reference position sensors which failed to deliver outputs.

The engine ignition interpolation apparatus according to the present invention includes three reference position sensors, a single crank angle sensor and a counter resettable by outputs from the reference position sensors and used for counting output pulses from the crank angle sensor. Also included are a decoder which generates an output when the counter produces a count output which exceeds a preset value, flip-flops connected respectively to the reference position sensors in a ring arrangement and triggerable by the outputs from the reference position sensors for synchronous operation therewith, and a logic circuit which seeks conformity between the output from the decoder and the set outputs from the flip-flops to produce a quasi or replacement pulse for one or more of the reference position sensors which fail to produce an output, thereby interpolating the reference position pulses.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3, including

DESCRIPTION OF THE PREFERRED EMBODIMENTS

Figure 1:
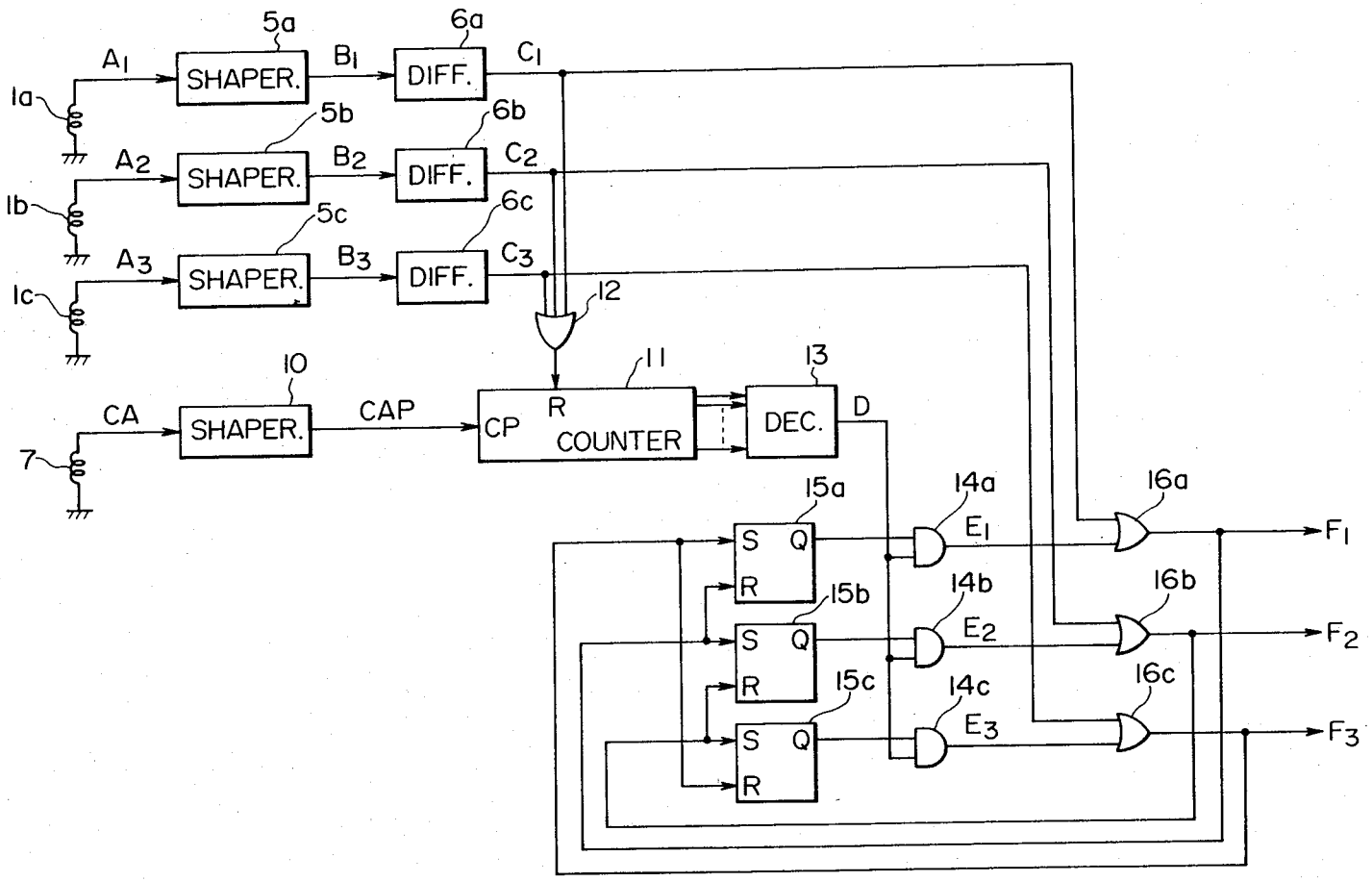
FIG. 1 is a circuit diagram of an engine ignition control apparatus according to an embodiment of the present invention.
Figure 2:
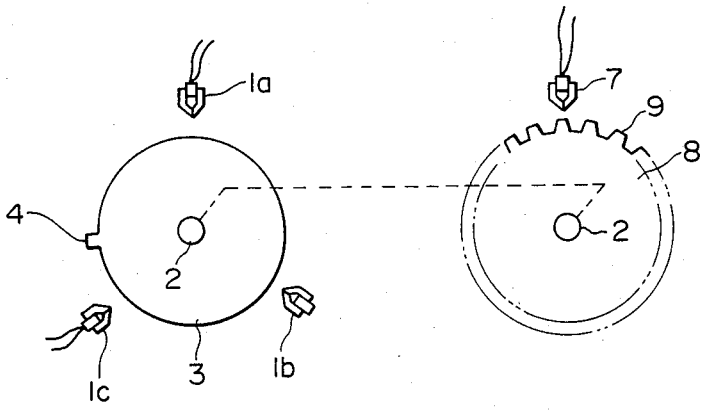
FIG. 2 is a side elevational view of reference position sensors and a crank angle sensor for the engine ignition control apparatus of FIG. 1.

FIG. 1 is a circuit diagram of an engine ignition interpolation apparatus according to an embodiment of the present invention. In the illustrated embodiment, the engine ignition interpolation apparatus is used in the ignition control for three ignition coils. As shown in FIG. 1, reference position sensors 1*a* through 1*c* are provided for engine piston position detection. As shown in FIG. 2, the reference position sensors 1*a*–1*c* are spaced at angular intervals of 120° around and adjacent to the outer periphery of a reference position rotor 3 mounted on a crank shaft 2. The reference position sensors 1*a*–1*c* serve to generate position detection signals, respectively, by magnetically detecting passage thereacross of a projection 4 on the outer peripheral edge of the reference position rotor 3. Waveform shapers 5*a*–5*c* change detection signals $A_1$–$A_3$ generated respectively by the reference position sensors 1*a*–1*c* into rectangular waveform signals $B_1$–$B_3$ (FIG. 3). The trailing edges of signals $B_1$–$B_3$ are differentiated by respective trailing-edge differential circuits 6*a*–6*c* to produce differential pulses $C_1$–$C_3$. As illustrated in FIG. 2, a crank angle sensor 7 is located adjacent to the outer periphery of a crank angle rotor 8 mounted on the crank shaft 2 and generates a crank angle detection signal CA by magnetically detecting the passage thereacross of teeth 9 cut at a pitch of 2° around the outer peripheral edge of the crank angle rotor 8. The detection signal CA is shaped by a waveform shaper 10 into rectangular crank angle pulses CAP, which are then successively counted by a counter 11. The counter 11 counts pulses up to a maximum count which is equal to 1 plus the quotient obtained by dividing the number of the teeth 9 on the crank angle rotor 8 by the number of the reference position sensors 1*a*–1*c*. In the illustrated embodiment, the number of teeth 9 is 360°/2°=180, since they are cut at the pitch of 2°, and hence the maximum count is 180/3+1=61. The output count signal produced by the counter 11 is a 6-bit signal. The counter 11 can be reset by the differential pulses $C_1$–$C_3$ supplied from the trailing-edge differential circuits 6a–6c through an OR gate 12. When the count from the counter 11 exceeds a value obtained by dividing the number of the teeth 9 on the crank angle rotor 8 by 3, or reaches "61", a decoder 13 generates a failure detection signal D indicative of the failure of one of the reference position sensors 1a–1c. AND gates 14a–14c produce output signals $E_1$–$E_3$ when the failure detection signal D from the decoder 13 is equal to the set outputs from flip-flops 15a–15c. OR gates 16a–16c are supplied with the trailing-edge differential signals $C_1$–$C_3$ and with the output signals $E_1$–$E_3$ from the AND gates 14a–14c to deliver reference position pulses $F_1$–$F_3$. The flip-flop 15a is set by the reference position pulse $F_3$ and reset by the reference position pulse $F_1$. The flip-flop 16b is set by the reference position pulse $F_1$ and reset by the reference position pulse $F_2$. The flip-flop 15c is set by the reference position pulse $F_2$ and reset by the reference position pulse $F_3$.

Figures 3A, 3B, 3C, 3D, 3E, 3F, 3G, 3H, 3I, 3J, 3K, 3L, 3M, 3N:
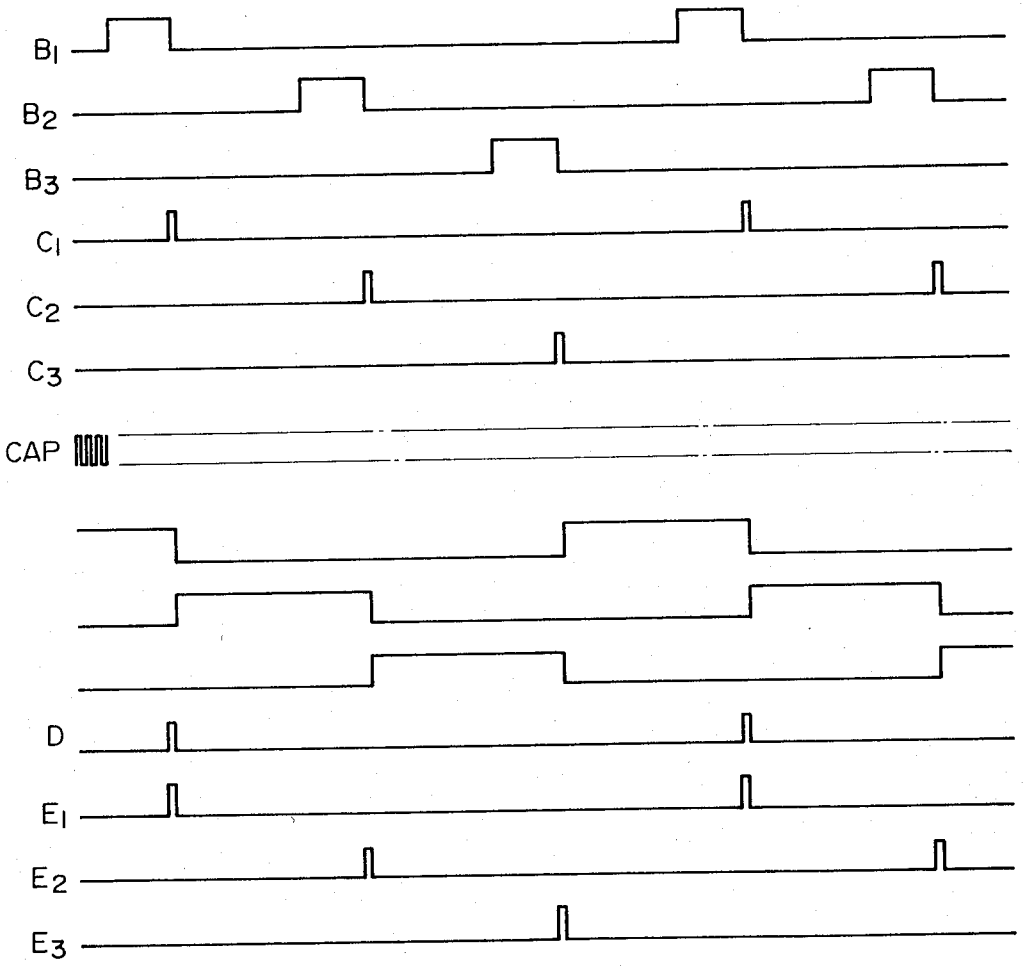
FIGS. 3(A)–3(N), is a signal diagram of waveforms of signals produced in the engine ignition control apparatus of FIG. 1.

During operation, when the crank shaft 2 rotates, the reference position rotor 3 and the crank angle rotor 8 both mounted on the crank shaft 2 rotate therewith. Since the reference position sensors 1a–1c are angularly spaced 120° apart, they produce detection signals $A_1$–$A_3$ when they successively detect passage of the projection 4 each time the crank shaft 2 angularly moves through 120°. The detection signals $A_1$–$A_3$ are respectively shaped by the waveform shapers 5a–5c into rectangular signals $B_1$–$B_3$ as shown in FIGS. 3(A)–3(C). The rectangular signals $B_1$–$B_3$ are respectively differentiated by the trailing-edge differential circuits 6a–6c, which then issue differential pulses $C_1$–$C_3$ as shown in FIGS. 3(D)–3(F).

The crank angle sensor 7 produces a detection signal CA, having a period dependent on the speed of rotation of the crank shaft 2, by detecting passage of the teeth 9 on the crank angle rotor 8. The detection signal CA is shaped by the waveform shaper 10 into rectangular crank angle pulses CAP spaced at the 2° pitch as shown in FIG. 3(G), which are then supplied to the counter 11. The counter 11 successively counts the crank angle pulses CAP from the waveform shaper 10, the counter 11 having been reset by the differential pulses $C_1$–$C_3$ supplied via the OR gate 12. Since the reference position rotor 3 and the crank angle rotor 8 are mounted on the crank shaft 2 and co-rotate, and with the reference position sensors 1a–1c being angularly equidistant around the reference position rotor 3, the differential pulses $C_1$–$C_3$ will be generated in succession each time 60 crank angle pulses CAP are produced when the reference position sensors 1a–1c operate normally. Thus, the counter 11 is repeatedly reset each time its count reaches "60", and the count output does not exceed "60". As long as the reference position sensors 1a–1c operate under normal conditions, no failure signal D is issued by the decoder 13 which serves to detect when the count output of the counter 11 exceeds "60". The AND gates 14a–14c therefore remain closed. The OR gates 16a–16c deliver the differential pulses $C_1$–$C_3$ supplied from the trailing-edge differential circuits 6a–6c as the reference position pulses $F_1$–$F_3$.

The flip-flops 15a–15c are set by the reference position pulses $F_3$, $F_1$, $F_2$, respectively, and reset by the set inputs signals of the following flip-flops, respectively, the levels of the set outputs Q being as shown in FIGS. 3(H)–3(J), respectively. If the reference position sensor 1a fails to operate, then the differential pulse $C_1$ shown in FIG. 3(D) will not be produced. The counter 11 therefore fails to be reset and its count reaches "61". The decoder 13 detects the count "61" and produces a signal D indicative of the absence of the differential pulse $C_1$. Accordingly, when the reference position sensor 1a fails to operate due, for example, to wire breakage, the decoder 13 produces the detection signal D as shown in FIG. 3(K). When the detection signal D is generated, the detection signal D and the set outputs from the flip-flops 15a–15c are logically combined by the AND gates 14a–14c, respectively. Since the flip-flops 15a–15c are successively triggered by the normal differential pulses $C_1$–$C_3$, only the AND gate 14a produces an output signal $E_1$ as shown in FIG. 3(L). The output signal $E_1$ is substantially synchronous with the differential pulse $C_1$ which would otherwise fail to be produced, and is delivered through the OR gate 16a to thereby interpolate the reference position pulse $F_1$. The foregoing operation holds true when the reference position sensors 1b and 1c fail to produce an output, that is, the AND gates 16b and 16c produce output signals $E_2$ and $E_3$, as shown in FIGS. 3(M) and 3(N), to interpolate the reference position pulses $F_2$ and $F_3$ which would otherwise not be produced.

When the counting capacity of the counter 11 is sufficiently larger than the normal maximum count thereof, it is necessary that the counter 11 be reset by the detection signal D produced by the decoder 13 which would require a connection of the output of the decoder 13 to the reset input R of the counter 11 through an OR gate.

Figure 4:
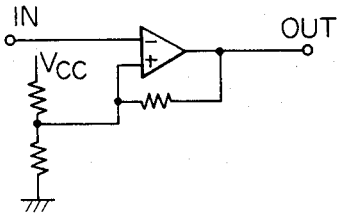
FIG. 4 is a circuit diagram for waveform shaper circuits of FIG. 1.

FIG. 4 is a circuit diagram of the waveform shaper circuits 5a–5c and 10 of FIG. 1. The signal to be shaped (detection signals) is applied to the input terminal In and emerges as square waves at output terminal Out, as illustrated in FIGS. 3(A)–3(C) and 3(G).

Figure 5:
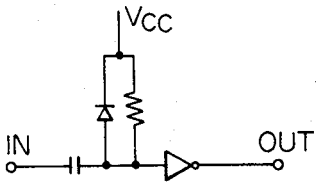
FIG. 5 is a circuit diagram for trailing edge differential circuits of FIG. 1.

FIG. 5 is a circuit diagram of the trailing edge differential circuits 6a–6b of FIG. 1. The signal to be differentiated is applied to the input terminal In and emerges as narrow pulses at the output terminal Out, as illustrated in FIGS. 3(D)–3(F).

With the arrangement of the present invention, as described above, the engine ignition control apparatus has a counter which is reset by outputs from reference position sensors and successively counts output pulses from a crank angle sensor, and failure of any reference position sensor is detected when the count output from the counter exceeds a predetermined value, whereupon one of several flip-flops connected in a ring arrangement and operating synchronously with the outputs from the reference position sensors produces an output to interpolate reference position pulses which would otherwise be produced by the faulty reference position sensor. Accordingly, even if any of three reference position sensors or a pair of the sensors fail to produce an output, they will automatically be interpolated for fail-safe ignition control for continued engine operation.

The many features and advantages of the invention are apparent from the detailed specification and thus it is intended by the appended claims to cover all such features and advantages of the apparatus which fall within the true spirit and scope of the invention. Further, since numerous modifications and changes will readily occur to those skilled in the art, it is not desired to limit the invention to the exact construction and operation illustrated and described and accordingly all suitable modifications and equivalents may be resorted to, falling within the scope of the invention.

What is claimed is:

1. An engine ignition interpolation apparatus operatively connectable to an engine having an engine crank and pistons, comprising:

reference position signal generation means for generating first through third reference position signals indicative of the position of the pistons in the engine;

crank angle signal generation means for generating a crank angle signal indicative of the crank angle; and signal processing means, operatively connected to said referenced position signal generation means and said crank angle signal generation means, for generating first through third primary ignition signals in dependence upon the first through third reference position signals and for generating first through third replacement ignition signals to replace the first through third primary ignition signals when one or a pair of the first through third reference position signals are absent in dependence upon the crank angle signal and the remaining first through third primary ignition signals.

2. An engine ignition interpolation apparatus as recited in claim 1, wherein said signal processing means comprises:

primary ignition signal generation means, operatively connected to said reference position signal generation means, for generating the first through third primary ignition signals in dependence upon the first through third reference position signals;

replacement ignition signal generation means, operatively connected to said crank angle signal generation means and said primary ignition signal generation means, for generating the first through third replacement ignition signals in dependence upon the first through third primary ignition signals and the crank angle signal; and output means, operatively connected to said primary ignition signal generation means and said replacement ignition signal generation means, for outputting either the replacement ignition signals or the primary ignition signals.

3. An engine ignition interpolation apparatus as recited in claim 2, wherein said replacement ignition signal generation means comprises:

a counter, operatively connected to said crank angle signal generation means and said primary ignition signal generation means, for counting the crank angle signals in dependence upon the first through third primary ignition signals;

a decoder, operatively connected to said counter, for outputting a failure signal in dependence upon a predetermined count in said counter; and logic means, operatively connected to said decoder and said output means, for generating the first through third replacement ignition signals in dependence upon the failure signal and the output produced by said output means.

4. An engine ignition interpolation apparatus as recited in claim 3, wherein said logic means comprises:

first through third AND gates operatively connected to said decoder and said output means; and first through third flip-flops operatively connected to said first through third AND gates, respectively, and said output means.

5. An engine ignition interpolation apparatus as recited in claim 4, wherein said replacement ignition signal generation means further comprises:

a waveform shaper circuit operatively connected between said crank angle signal generation means and said counter; and an OR gate operatively connected between said primary ignition signal generation means and said counter.

6. An engine ignition interpolation apparatus as recited in claim 2, wherein said primary ignition signal generation means comprises first through third trailing-edge differential circuits, operatively connected to said reference position signal generation means, said replacement ignition signal generation means and said output means, for generating the first through third primary ignition signals from the first through third reference position signals, respectively.

7. An engine ignition interpolation apparatus as recited in claim 6, wherein said primary ignition signal generation means, further comprises first through third waveform shape circuits operatively connected between said reference position signal generation means and said first through third trailing-edge differential circuits, respectively.

8. An engine ignition interpolation apparatus as recited in claim 2, wherein said output means comprises first through third OR gates operatively connected to said primary ignition signal generation means and said replacement ignition signal generation means.

9. An engine ignition interpolation apparatus as recited in claim 1, 2, 3, 4, 5, 6, 7 or 8, wherein said crank angle signal generation means comprises:

a crank angle rotor attached to the engine crank and having teeth formed on a periphery thereof; and a sensor, positioned across from the periphery of said crank angle rotor and operatively connected to said signal processing means, for generating the crank angle signal each time one of the teeth passes thereby.

10. An engine ignition interpolation apparatus as recited in claim 9, wherein said crank angle rotor has 180 teeth.

11. An engine ignition interpolation apparatus as recited in claim 1, 2, 3, 4, 5, 6, 7 or 8, wherein said reference position signal generation means comprises:

a reference position rotor attached to the engine crank and having a tooth formed on a periphery thereof; and first through third reference position sensors, positioned across from the periphery of said reference position rotor and operatively connected to said signal processing means, each for generating respective reference position signals each time the tooth passes thereby.

12. An engine ignition interpolation apparatus as recited in claim 11, wherein said first through third reference position sensors are spaced angularly around the periphery of said reference position rotor 120° apart.

* * * * *